US010801818B2

(12) United States Patent
Allen

(10) Patent No.: US 10,801,818 B2
(45) Date of Patent: Oct. 13, 2020

(54) METHOD AND DEVICE FOR MICRO BLASTING WITH REUSABLE BLASTING RODS AND ELECTRICALLY IGNITED CARTRIDGES

(71) Applicant: Dana Raymond Allen, Reno, NV (US)

(72) Inventor: Dana Raymond Allen, Reno, NV (US)

( * ) Notice: Subject to any disclaimer, the term of this patent is extended or adjusted under 35 U.S.C. 154(b) by 634 days.

(21) Appl. No.: 14/261,432

(22) Filed: Apr. 25, 2014

(65) Prior Publication Data

US 2015/0308796 A1 Oct. 29, 2015

Related U.S. Application Data

(60) Provisional application No. 61/816,156, filed on Apr. 26, 2013.

(51) Int. Cl.

| | |
|---|---|
| ***F42B 3/00*** | (2006.01) |
| ***F42B 3/12*** | (2006.01) |
| ***F42D 1/045*** | (2006.01) |
| ***F42D 3/04*** | (2006.01) |

(52) U.S. Cl.

CPC ..... *F42B 3/124* (2013.01); *F42D 1/045* (2013.01); *F42D 3/04* (2013.01)

(58) Field of Classification Search

CPC .. F42B 3/124; F42B 3/113; F42B 3/00; F42B 1/02

USPC ..... 102/301, 200, 476, 439, 309, 430

See application file for complete search history.

(56) References Cited

U.S. PATENT DOCUMENTS

| | | | | |
|---|---|---|---|---|
| 1,832,132 A | | 11/1931 | Lanier | |
| 2,440,568 A | * | 4/1948 | Arter | F42B 5/16 102/430 |
| 2,476,370 A | * | 7/1949 | Hanley | F42B 3/128 102/202.14 |
| 3,040,660 A | * | 6/1962 | Johnston | C06C 7/00 102/202.7 |
| 3,156,186 A | * | 11/1964 | Picciano | C06B 33/04 102/202.7 |

(Continued)

OTHER PUBLICATIONS

Reference from Alternative Blasting Co. (website excerpt) that sells AutoStem rock breaking cartridges, retrieved on Dec. 15, 2016 from http://AlternativeBlastingCo.com/, 25 pp.

(Continued)

*Primary Examiner* — Michael D David

(57) ABSTRACT

An apparatus, method and system to electrically ignite small explosive cartridges in boulders, bedrock, concrete etc. to split or shape them. A propellant or explosive charge is electrically ignited directly by an inert electrical igniter inserted therein that melts at high temperature a bridge wire(s) or ribbon(s) with AC or DC electrical current. The bridge melts normally at over 2,000 degrees F. which will ignite the propellant or explosive. With sufficient voltage and amperage such as 110 volt AC wall current ionization takes place along the pathway of the melting bridge, which melts at approximately 2,000 degrees F., and a large electrical arc forms at approximately 5,000 degrees F. that more reliably ignites the propellant or explosive with increased blast power. A reusable blasting rod includes an external groove for a blasting wire, a counterweight for better tamping, which has a cradle for heavy objects to utilize the Newton Kinetic effect.

23 Claims, 4 Drawing Sheets

(56) References Cited

U.S. PATENT DOCUMENTS 3,159,103 A * 12/1964 Bagley ..... F42B 3/12 102/202
3,181,464 A * 5/1965 Parker ..... F42B 3/125 102/202.7
3,249,049 A * 5/1966 Zimmerman ..... F42B 5/08 102/202.8
3,275,098 A * 9/1966 Filler ..... G01V 1/047 102/301
3,514,749 A * 5/1970 Padberg, Jr. ..... G01V 1/09 181/109
3,608,492 A * 9/1971 Mitchell ..... F41A 19/58 102/202.8
3,812,783 A * 5/1974 Yang ..... H01S 3/0007 102/201
3,831,523 A * 8/1974 Thomas ..... F42B 3/18 102/202.1
4,286,498 A * 9/1981 Block ..... F42B 12/70 102/505
4,307,665 A * 12/1981 Block ..... F42B 12/70 102/357
4,324,060 A * 4/1982 Lawrence ..... F42B 5/08 102/202.9
4,391,195 A * 7/1983 Shann ..... F42B 3/113 102/201
4,429,632 A * 2/1984 Yunan ..... F42B 3/16 102/202.13
4,574,702 A * 3/1986 Brandt ..... F42B 10/48 102/244
4,711,181 A * 12/1987 Ringel ..... F42B 1/02 102/309
4,718,954 A * 1/1988 Machacek ..... C06B 31/28 102/313
4,777,878 A * 10/1988 Johnson ..... E21B 43/1185 102/202.5
4,862,802 A * 9/1989 Streifer ..... F42B 3/113 102/201
4,862,804 A * 9/1989 Chawla ..... F42B 3/113 102/307
4,887,534 A * 12/1989 Dickovich ..... F42B 5/073 102/373
4,892,037 A * 1/1990 Betts ..... F42B 3/113 102/201
4,896,609 A * 1/1990 Betts ..... F42B 1/02 102/307
4,907,487 A * 3/1990 Tidman ..... F41B 6/00 124/3
4,917,017 A * 4/1990 Beltz ..... C06C 5/04 102/275.1
4,967,637 A * 11/1990 Loffler ..... F41B 6/00 102/374
4,982,667 A * 1/1991 Weimann ..... F42B 1/02 102/306
5,007,345 A * 4/1991 O'Garr ..... F42D 1/10 102/312
5,010,804 A * 4/1991 Lee ..... F41A 1/00 89/7
5,042,359 A * 8/1991 Witt ..... E02D 29/14 102/375
5,052,302 A * 10/1991 Taddeo ..... F42C 19/0826 102/204
5,147,978 A * 9/1992 Northrup ..... F42B 5/045 102/434
5,148,748 A * 9/1992 Yarrington ..... F42B 3/113 102/201
5,148,750 A * 9/1992 Becker ..... F42B 14/061 102/439
5,225,624 A * 7/1993 Schneider ..... F42C 19/0811 102/202.7
H001214 H * 8/1993 Liva ..... F42B 3/113 102/201
5,355,764 A * 10/1994 Marinos ..... F41B 6/00 102/472
5,400,715 A * 3/1995 Roach ..... F42B 5/181 102/202
5,503,058 A * 4/1996 Marinos ..... F41B 6/00 102/202.7
5,695,215 A * 12/1997 Headley ..... B60R 21/264 102/202.14
5,728,964 A * 3/1998 Avory ..... C06B 33/06 102/202.14
5,736,668 A * 4/1998 Fogle, Jr. ..... B60R 21/264 102/202.5
5,763,816 A * 6/1998 Keeling ..... F42B 3/00 102/275.11
6,073,895 A * 6/2000 Isbell ..... F41G 1/38 248/201
6,186,040 B1 * 2/2001 Weise ..... F41B 6/00 102/472
6,332,402 B1 * 12/2001 Weise ..... F42B 5/08 102/202.5
6,332,403 B1 * 12/2001 Weise ..... F42B 5/08 102/202.5
6,408,765 B1 * 6/2002 Tauber ..... F42B 30/06 102/275.3
6,936,303 B1 * 8/2005 Katsuda ..... B60R 21/2644 29/592.1
7,568,431 B1 * 8/2009 Stria ..... F42B 4/24 102/202.14
8,297,190 B1 * 10/2012 Dindl ..... F42B 5/145 102/430
8,479,651 B2 * 7/2013 Schaeffer ..... F41A 33/04 102/200
8,502,077 B2 * 8/2013 Kay ..... F42D 1/043 102/202.5
2001/0032563 A1 * 10/2001 Weise ..... F42B 5/08 102/202
2002/0005136 A1 * 1/2002 Weise ..... C06B 33/08 102/472
2003/0029307 A1 * 2/2003 Daoud ..... F15B 15/063 89/1.14
2003/0033953 A1 * 2/2003 Haak ..... F42B 5/08 102/431
2003/0209162 A1 * 11/2003 Schmees ..... F42B 5/08 102/472
2005/0257675 A1 11/2005 Bassett
2008/0185904 A1 8/2008 Bassett
2008/0216806 A1 * 9/2008 Tseng ..... F41B 1/00 124/62
2009/0223401 A1 * 9/2009 Fronabarger ..... C06C 7/00 102/202.7
2010/0162912 A1 * 7/2010 Kay ..... F42D 1/043 102/202.14
2010/0276984 A1 11/2010 Bassett
2012/0024178 A1 * 2/2012 Fronabarger ..... F42B 3/124 102/202.7
2012/0145027 A1 * 6/2012 Martin ..... F42D 1/16 102/313
2012/0180679 A1 * 7/2012 Schaeffer ..... F41A 33/04 102/206

OTHER PUBLICATIONS

Reference from AutoStem Co. (website excerpt) that designs AutoStem rock breaking cartridges, retrieved on Dec. 16, 2016 from http://www.AutoStemTechnology.com/rockbreakingcartridges, 8 pp.

Reference from U.S. Forest Service Publications (website) instructing use of Boulder Buster rock-breaking cartridges, retrieved on Dec. 27, 2016 from https://www.fhwa.dot.gov/environment/recreational_trails/publications/fs_publications/98672840/page01.cfm, 4 pp.

* cited by examiner

METHOD AND DEVICE FOR MICRO BLASTING WITH REUSABLE BLASTING RODS AND ELECTRICALLY IGNITED CARTRIDGES

FIELD OF THE INVENTION

The present disclosure of this invention relates generally to the field of blasting with cartridges that have propellant or explosive charges and other methods of splitting rocks, concrete and bedrock.

DESCRIPTION OF THE RELATED ART

Currently large scale blasting, such as that used in open pit mines, requires the use of highly dangerous explosives that can dismember a person. There are small blasting systems that involve drilling a hole in a rock and using explosive primers that explode on contact and are mechanically initiated primarily through firing pins traveling long distances through the center of blasting rods and striking the explosive primer. The explosive primer then ignites additional propellant or explosives to generate a pressure to crack the rock. U.S. Pat. No. 7,069,862 describes one of these blasting inventions that uses a spring and lanyard firing method. CA 2599106 C is another patent of this type.

Another method of blasting rock is to mechanically fire the long firing pin by using air pressure generated from air tanks or air compressors. The air pressure drives the firing pin like a blow dart until it hits the explosive primer in the cartridge underneath the hollow tamping rod as described in patent CA 2599106 C. The current state of the art has safety, versatility and reliability issues.

Lanyard triggered gravity firing systems do not allow blasting sideways or overhead. The long firing pins which can be 8 inches long are prone to sticking due to corrosion, clogging from blast dust and if the blasting rod is even slightly bent it will bind the firing pin inside the rod. They are primarily used for just one blasting head. Coordinating multiple heads to go off at precisely the same time would be virtually impossible, because pulling multiple strings at precisely the same time would be involved.

Air pressure fired firing pin systems require a heavy air compressor or some form of an air tank, air manifolds, air hoses, and often require very high pressures, such as 120 psi, to be effective in pushing the firing pins into the explosive primer. This is an issue as miners often need to back pack blasting systems into remote areas. For multiple head blasts some air pressure fired systems can accomplish such by using a large air tank with air manifolds and multiple air hoses to go to the various blasting heads. However, mechanical firing pins propelled by air pressure to multiple blasting heads will have precise timing issues. The maximum number of blasting heads currently marketed to be used at once is approximately three.

Other small blasting systems include U.S. Pat. No. 4,669,783 A, entitled "PROCESS AND APPARATUS FOR FRAGMENTING ROCK AND LIKE MATERIAL USING EXPLOSION-FREE HIGH PRESSURE SHOCK WAVES", and U.S. Pat. No. 6,339,992 B1, entitled "SMALL CHARGE BLASTING APPARATUS INCLUDING DEVICE FOR SEALING PRESSURIZED FLUIDS IN HOLES", both which use a small charge blasting apparatus including device for sealing pressurized fluids in holes. One method that does utilize electrical firing is U.S. Pat. No. 8,342,095 B2, entitled "SELF-STEMMING CARTRIDGE", which uses a different method of tamping and igniting the propellant/explosive.

U.S. Pat. No. 3,040,660, electric initiator with exploding bridge wire, does have the precise timing as does the present disclosure, but its purpose and method are different. Its purpose it to directly detonate high explosives with the explosive force of the bridge explosion and the precise timing is for atomic bomb detonation by detonating explosives on different sides of the nuclear fissionable material as simultaneously as possible. The current disclosure is designed for igniting, not detonating, and is mostly for propellants and low explosives, not focused on high explosives, and is unlikely to be quite at precise timing wise that U.S. Pat. No. 3,040,660 achieves.

SUMMARY

The present disclosure involves the novel features of the cartridges themselves and the blast containment system that consists of reusable blasting rods with various systems, methods and apparatuses to prevent rapid expulsion of the rod from the blast hole on ignition and to do so in a safe manner. In particular the current disclosure includes the electrical melting and electrical arcing of thin metal wire or ribbon directly within the propellant/explosive charge without dangerous pyrotechnic or explosives to ignite the charge. This provides an inert igniter that is not sensitive to shock or heat. After the electrical bridge melts, an electrical arc forms even with standard 110 AC wall current as the air is ionized and more conductive after heating, which aids ignition reliability and often improves the explosive power of propellants due to the higher initiation temperature.

The present disclosure provides reusable blasting heads and rods so as to speed blasting operation and reduce costs. The current disclosure eliminates many of the current limitations of the state of the art, including being able to fire multiple heads precisely at the same time as electricity is the initiating event, being water resistant, being lightweight, having fast setup time and having a solid blasting rod with an external path for the blasting wire that can be easily cleaned if it clogs with blast dust.

The invention also has the ability to increase blasting power by simply inserting extra cartridges into the hole before lowering the primary charge that attaches to a nipple at the end of the blasting head rod. When the primary cartridge is ignited it reliably ignites other cartridges in the same blast hole whether they are primary cartridges with igniters or booster cartridges which have no igniters. Booster cartridges have just propellant or explosives inside the case of the cartridge.

DETAILED DESCRIPTION OF THE DRAWINGS

Figure 1:
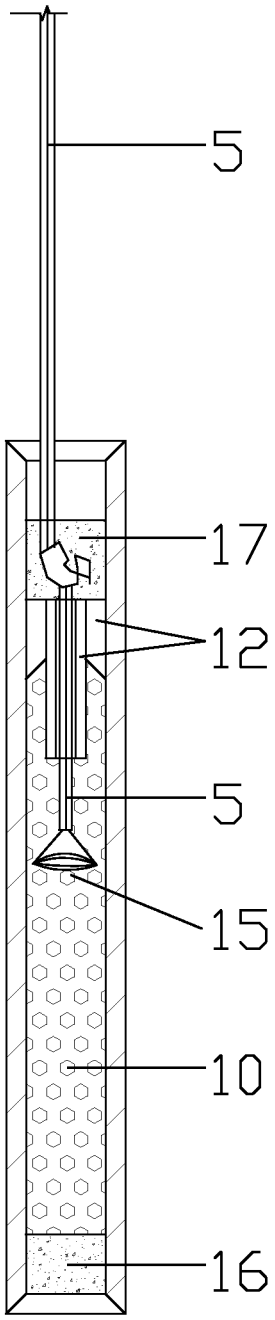
FIG. 1 is a drawing (with many sub-components) of the cartridge, according to one or more embodiments.

The present disclosure provides an apparatus, system, and method with several embodiments that overcome the limitations of the prior art. The present disclosure accomplishes this by having an inert igniter that is ignited by electrical current. Referring now to FIG. 1, one embodiment connects the igniter is thin metal wire(s) or ribbon(s) 15 between two conductors of the blasting wire and is disposed directly in the propellant or explosive material 10. A firing system sends DC or AC current down the blasting cartridge wire 5 to the igniter bridge 15 that connects those two wires with an inert thin metal wire(s) or ribbon(s). AC current works very well for the present disclosure, and has simplicity advantages in terms of using an unaltered standard source of a wall outlet.

When the electrical current is applied by an electrical trigger 40, which is part of the overall blasting system, the thin metal igniter bridge 15 melts normally at over 2,000 degrees F. and also generates an electrical arc if there is sufficient voltage and amperage. The electrical arc is similar to an arc used for arc welding, which generates even more heat in addition to the molten metal. The material for the thin metal bridge is stainless steel in one embodiment, and in another embodiment multiple strands are used for extra reliability, although the invention is not limited to those embodiments and works well with other metals and works well with just one strand.

Figure 4:
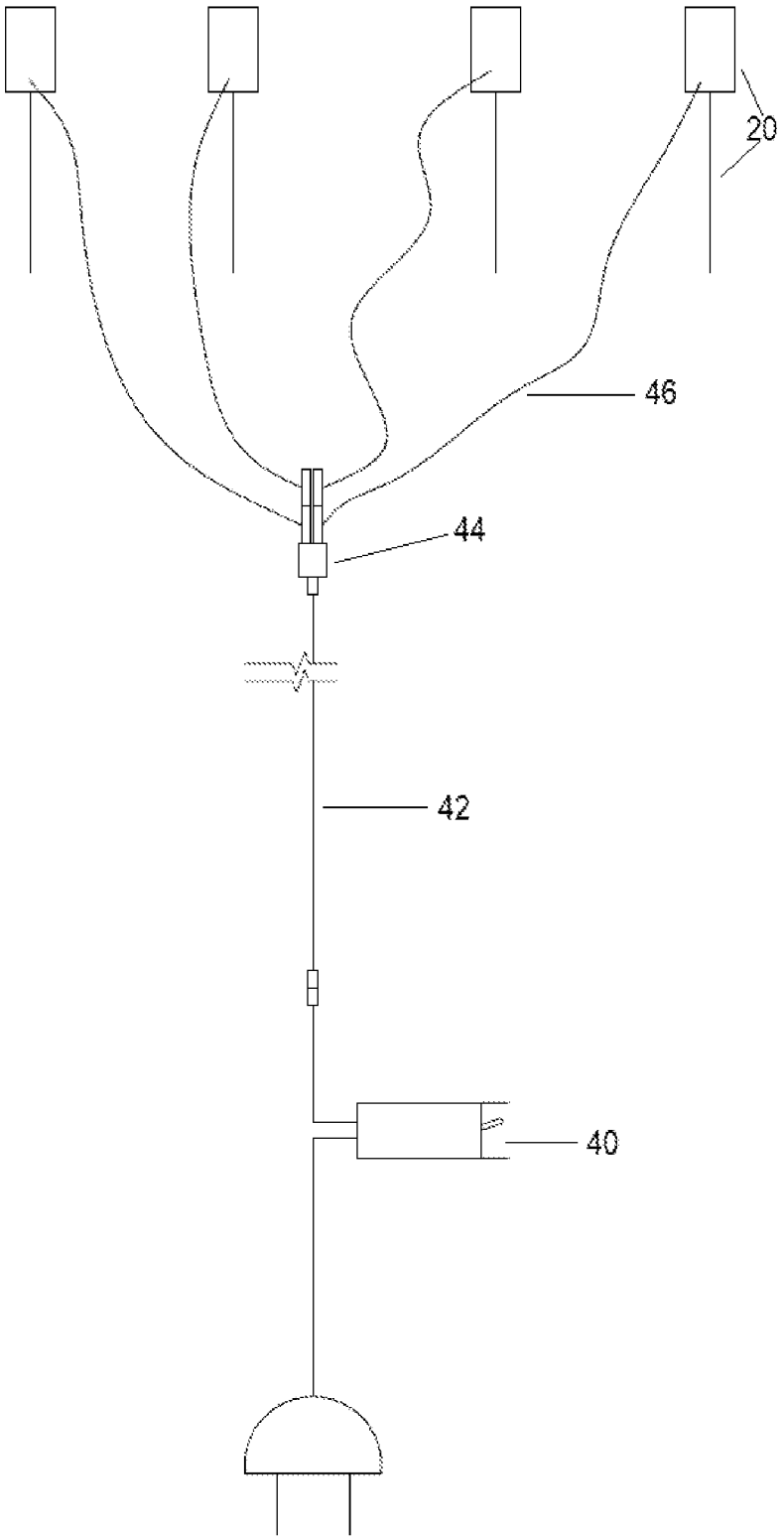
FIG. 4 is a electrical diagram of the trigger, wiring and blasting heads, according to one or more embodiments.

When the electrical current is applied by an electrical trigger 40, as shown in FIG. 4, which is part of the overall blasting system, the thin metal igniter bridge 15 melts normally at over 2,000 degrees F. and also generates an electrical arc if there is sufficient voltage and amperage. The electrical art is similar to an arc used for arc welding, which generates even more heat in addition to the molten metal. The material for the thin metal bridge is stainless steel in one embodiment, and in another embodiment multiple strands are used for extra reliability, although the invention is not limited to those embodiments and works well with other metals and works well with just one strand.

Any material that is conductive and will generate sufficient heat and then melt, thereby breaking the circuit and igniting the propellant/explosive, can be used. Pyrotechnic materials can be added to the electrical bridge but they are not required. This method and apparatus is reliable in igniting the propellant/explosive charge and is inert. The igniter bridge can be hammered or heated (just as long as it is significantly below its melting point, which is often over 2,000 degrees F. for stainless steel and many other appropriate materials) without catching fire or exploding, as it is inert. It is much safer that shotgun shell primers or pyrotechnic materials used by other igniter systems in terms of shock and heat resistance.

One embodiment uses propellants instead of high explosives so it can be shipped and stored with less legal requirements and expenses than explosives. These cartridges can be triggered outside of a drill hole with little noise and danger compared to explosives and uses little force compared to the force generated when they are contained in drill holes with a blasting rod. With protective welder's gloves, clothing, and face shield, a cartridge can be ignited on a heavily gloved hand without harming the person. Yet in a blast hole with containment the same cartridge can split a 3 foot diameter rock boulder into two or more pieces.

Figure 5:
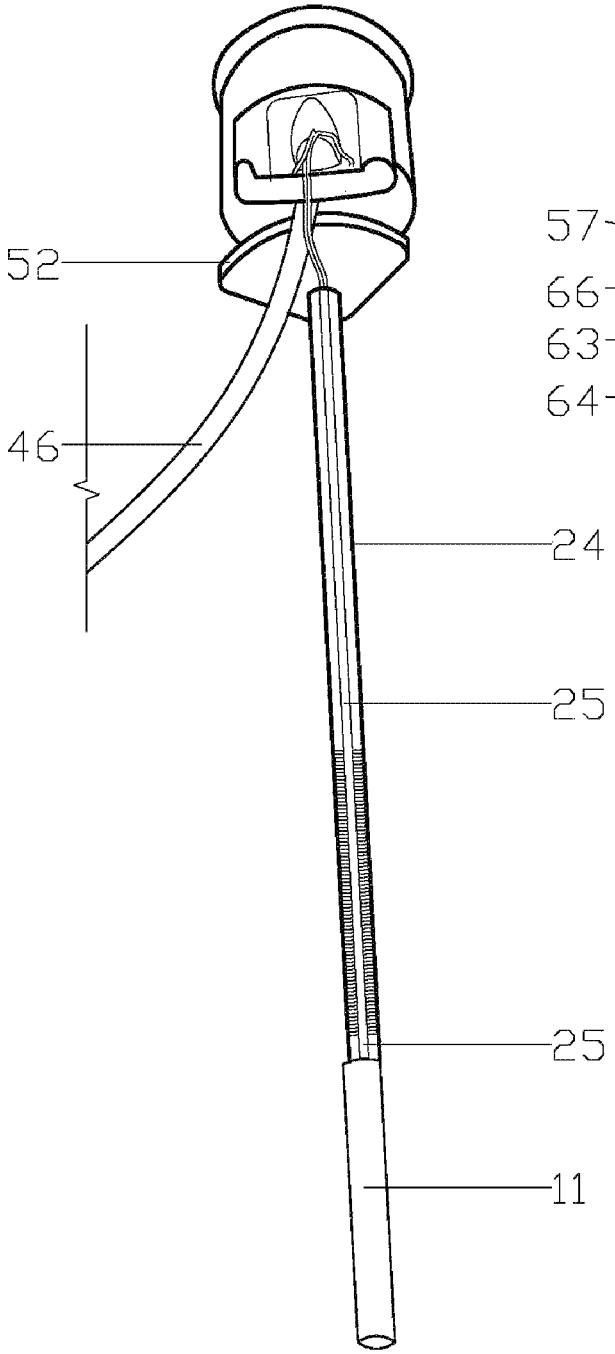
FIG. 5 is a detail view of a blasting head, blast cord, blasting wire and cartridge of the present invention, according to one or more embodiments.

The cartridge 11 in one embodiment is a plastic tube such as the 0.375" OD and 0.25" ID one that is sealed on both ends as shown in FIG. 5 and also shown in exploded detail in FIG. 1, so as to be water resistant. The invention is not restricted to that size. The cartridges 11 can thus be used underwater unlike the known state of the art on the market in which blasting cartridges are often rolled paper. The blasting wire 5 with the igniter bridge 15 is positioned in the cartridge tube with the preferred embodiment being the igniter bridge is centered in the powder for the fastest complete ignition time of all the propellant/explosive.

In the preferred embodiment, an additional plastic tube or tubes 12 surround the blasting wire 5 inside the main cartridge tube. This aids in centering the wire and provides additional containment of the high pressure gases that are generated on ignition. In one embodiment, a glue, molten plastic, or other material 17 that sticks to the inside of the main cartridge tube is then used to help seal the cartridge on the blasting wire side. To prevent the blasting wire from being pulled out of the cartridge the wire is knotted or otherwise deformed as seen in FIG. 1, between 17 and 12 so it takes a larger pulling force to pull the wire out of the cartridge. On the non-blasting wire side of the cartridge 11 the propellant/explosive charge 10 is contained in the cartridge by glue, molten plastic or other material 16.

Figure 2:
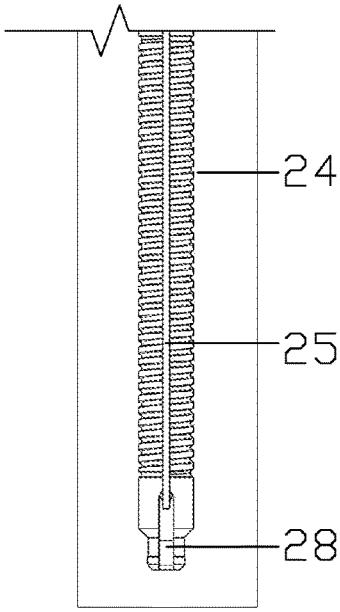
FIG. 2 is a view of the end of the blasting rod to which the cartridge attaches, according to one or more embodiments.
Figure 3:
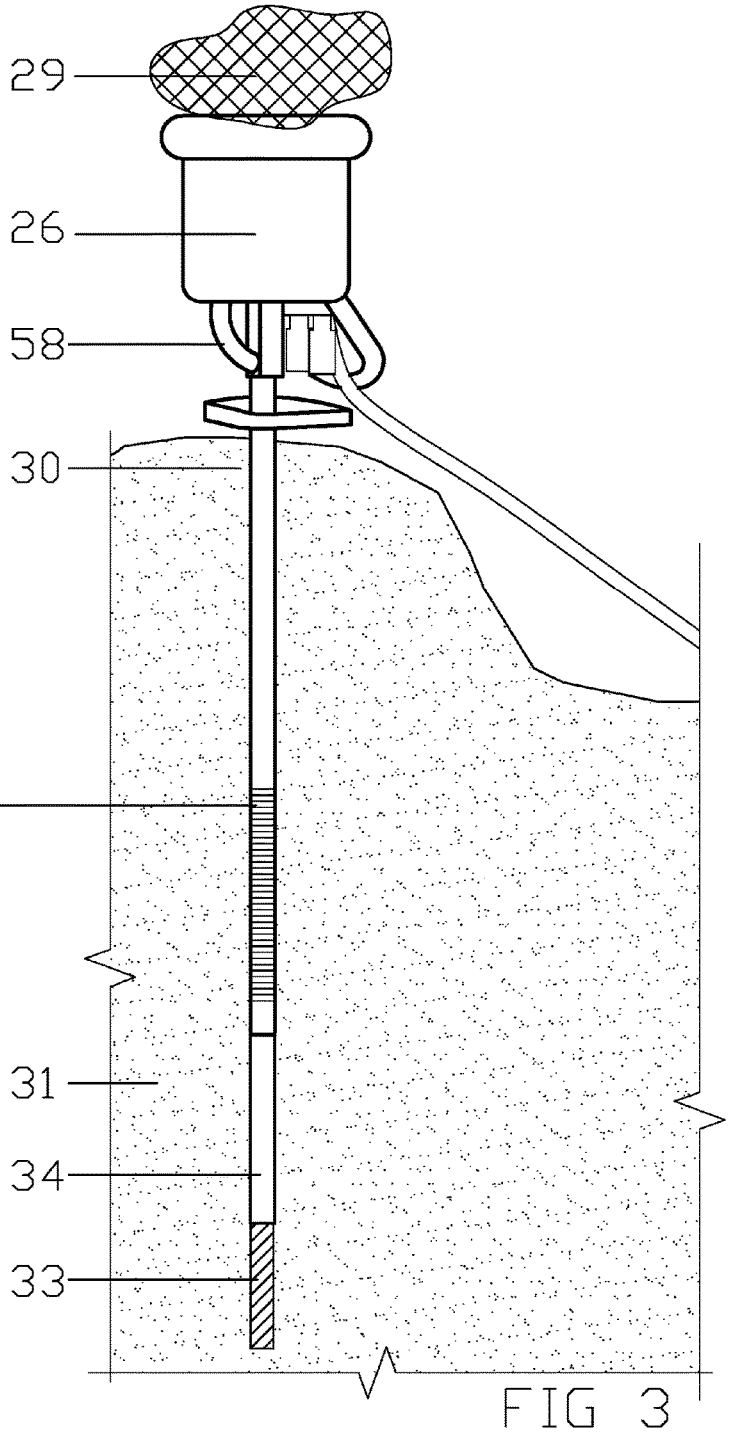
FIG. 3 is a view of the blasting rod installed into a drill hole after the pictured boulder has already been split by a blast, according to one or more embodiments.

The blasting head apparatus FIG. 4, 20 consists of a blasting rod FIGS. 2 and 5, 24 which has a groove FIG. 5, 25 on the outside for the blasting wire to fit in for insertion into the blast hole FIG. 3, 30 and a blasting head FIG. 3, 26. The blasting rod FIG. 3, 24 connects to the blasting head FIG. 3, 26 by welding, bolting or other known methods of attachment and provides a counterweight to the high pressure force of the blast that will try and push the blasting rod FIG. 3, 24 out of the drill hole FIG. 3, 30 in the rock, concrete or other desired material to blast as in FIG. 3, 31 on ignition. In addition to the weight of the blasting head FIG. 3, 26 this invention uses a method to further contain the force and pressure of the blast by having blasting head ring FIG. 6, 56 made of rubber or similar material to cradle an additional weight which is often but not limited to a rock as shown in FIG. 3, 29. During a blast the force is transferred through the blasting head into the rock, or other object FIG. 3, 29 similar to the kinetic energy effect of bowling balls or ball bearings in that the blasting head FIG. 3, 26 stays quite stationary and the rock or other additional weight placed on top of it is what moves. This method has many advantages including it reduces the weight of carrying the blasting system into the field and it greatly slows down the rising of the blasting rod on ignition so the space under the rod stays smaller longer which translates into higher pressures and better splitting force for the blast. The blasting head ring FIG. 6, 56 is rubbery also to provide a cushion if the blasting head FIG. 3, 26 hits another object or a person for improved safety.

The electrical current is delivered to the blasting wire FIG. 1, 5 from its source, whether that is standard wall current or a generator or a battery or other source, through the blasting trigger FIG. 3, 40 which in one embodiment converts AC current to DC or, if the source current is DC, then itleaves it as, via a bridge rectifier or similar converter. In the preferred embodiment the converter is part of the blasting trigger apparatus FIG. 3, 40. Converting to DC is optional as the present disclosure works very well with standard AC current. The electrical current exiting from the blasting trigger is transmitted into the blasting extension cord FIG. 4, 42 to the blasting electrical distributor FIG. 4, 44 which then distributes the electrical current to one or more blasting head cord(s) FIG. 4, 46 and the preferred embodiment is to have more than one place to plug in blasting head cords into the distributor for redundancy. The preferred embodiment for blasting head cords FIG. 4, 46 is a daisy chain feature on the connector that inserts into the blasting electrical distributor FIG. 4, 44, so that another blasting head cord can be plugged into the previous blasting head cord. which is plugged into the electrical distributor FIG. 4, 44. Thus, an electrical connection is made to the previous plug enabling even more concurrent blasts than the number of available plugs on the distributor. The blasting head plug 49 shown in FIG. 6 is just such a type of piggyback plug but on that end of the blasting head cord the holes for piggybacking are filled with the electrically connected push terminals 31.

Figure 6:
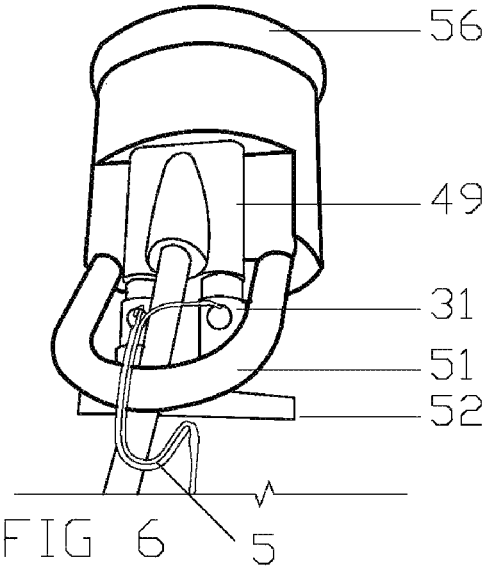
FIG. 6 is a detail view of the blasting head and the components that attach to the blasting head, according to one or more embodiments.

One embodiment uses push terminals FIG. 6, 31 to electrically and mechanically attached to the blasting head plug FIG. 4, 49 on the blasting head cord FIG. 5, 46. The blasting head cord FIG. 5, 46 in the preferred embodiment attaches to the blasting head via the blasting head plug FIG. 6, 49 without electrical connection to the blasting head, the female holes in the blasting head are non-conductive, but to position it for the push terminals FIG. 6, 31 to be near the blasting wire FIG. 6, 5 for connection and to provide a firm anchor point that is non-electrical. The blasting head plug FIG. 6, 49 is protected from damage from rocks and other blows during blasting by the blasting head plug protector rod FIG. 6, 51. It is also protected from blast dust and flame by a blast hole shield FIG. 5 and FIG. 6, 52 which pivots out of the way for connecting the blasting wire and then pivots back protecting the blasting head plug before ignition.

Figure 7:
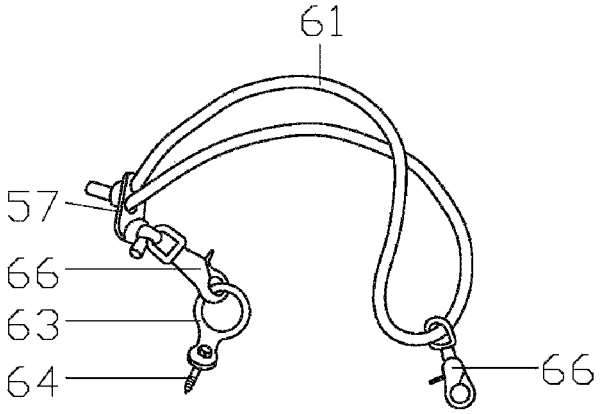
FIG. 7 is a detail view of the blasting head tether cord, according to one or more embodiments.

A blasting head tether cord FIG. 7, 61 is attached to the blasting head anchor FIG. 3, 58 with cord attachment FIG. 7, 66 and to an anchor plate FIG. 7, 63 and has a tether cinch FIG. 7, 57. This is to prevent the blasting head from flying through the air or rolling down a hill. The anchor plate FIG. 7, 63 is held to another boulder or other object by a screw FIG. 7, 64, or attached in another fashion to an object expected to stay in place. For sideways or overhead blasting this invention has an optional heavier blasting head that does not require a movable object to be placed on top of it for increased containment of the cartridge blast. The preferred embodiment for the blasting head tether cord FIG. 7, 61 uses an elastic cord such as a bungee cord for the tether cord so as to provide tension for sideways or overhead blasts, yet stretches so as to allow the blasting head apparatus to exit the blasting drill hole during the blast.

OPERATION OF THE INVENTION

The following operation of the invention is just one of many ways to use it and the current disclosure is not limited to this one method of operation. A way to use the invention is to first disconnect the blasting extension cord FIG. 4, 42 from the trigger cord for safety then optionally attach a shorting device not shown, into the now open blasting extension cord plug FIG. 4, 42 so as to prevent radio waves or the like from entering the wires in the cord. Then disconnect the blasting extension cord FIG. 4, 42 at the other end from the blasting electrical distributor FIG. 4, 44. The blasting head cords FIG. 4, 46 in the preferred embodiment are twisted pair wires to prevent radio or similar waves from entering them. The next step is to connect, if it is not already, the blasting head cord(s) 46 at both ends. Then drill a hole in the boulder, concrete, bedrock or other medium the user desires to split/blast, of approximately 8 inches to 12 inches in depth.

The hole can be drilled much deeper and if water or other liquid is put into the borehole a column of liquid can be created beneath the primary and or booster cartridge(s), which do float, or can be taped together. This allows for the pressure of the blast to be exerted over a longer column than the cartridges, as liquids are incompressible. Potentially if the water only column under the cartridges is about as long as the cartridge(s) are, the blast tension on the material being split or blasted could potentially be doubled with the same amount of explosive charge. This method of drilling past the cartridge placement has an additional advantage of weakening the rock/material being blasted as it removes more of the material next to the explosive force. Drilling in rock and concrete with the current state of the art is common and inexpensive. The drill hole FIG. 3, 30 is drilled slightly larger than the blasting head rod so the rod can be fit easily into the hole later. After the drill hole FIG. 3, 30 is drilled it can be brushed or blown out by air if necessary.

The cartridge FIG. 5,11 can then be attached to the blasting head rod nipple FIG. 2, 28 by pressing it over the nipple as there is a cavity in the cartridge for attaching to the nipple and doing so with the blasting wire FIG. 6, 5 aligned to the blasting head rod groove FIG. 5, 25. This cartridge holding apparatus and method of this invention makes extracting the cartridge easy in case the user decides to not blast after inserting it. Then the far end of the blasting wire FIG. 6, 5 can be inserted into the push terminals FIG. 6, 31 to electrically connect the blasting wire to the blasting head cord plug FIG. 6, 49. The user can next place the blasting wire into the groove with the preferred embodiment being to do so on its edge with the groove being a tight fit for better gas pressure containment during the blast. This can be done with a finger or thumb even with gloves on. At this point the cartridge FIG. 5, 11 is still not contained, it is in the open air.

Before inserting the blasting head rod with the attached cartridge as shown in FIG. 3 an additional booster cartridge FIG. 3, 33 or more than one depending on regulations can be inserted into the blasting hole to increase the power. Booster cartridges are ignited by the primary cartridge's heat and/or pressure reliably, without any igniter in the booster cartridge. FIG. 3, 34 shows the place on the blasting hole FIG. 3, 33 where the cartridge FIG. 5, 11 would be before the blast and where a booster cartridge would be located. The next step is to place the blasting head rod FIG. 2 and FIG. 3, 24 down into the blast hole with an installed cartridge FIG. 5, 11. If it gets stuck before or after the blast the user can rotate it in the preferred embodiment either by twisting the head with their hands with their head for safety out of line with the head or apply a wrench to the built in welded nut that is seen attached to the blasting head anchor FIG. 3, 58. The blasting head rod FIG. 2, 24 has threads FIG. 2, 25 on it near the bottom in the preferred embodiment to generate outward thrust similar to how a screw does when turned. The blasting rod threads FIG. 2, 25 serve another purpose as gases attempting to escape between the blasting rod and blasting hole during the blast are very high velocity, even supersonic, and the threads aid containment by generating turbulence to slow down the exit of the gases.

After the blasting head rod FIG. 3, 24 and cartridge(s) are placed into the blasting hole the user should be careful to avoid being in line with it, if it were to ignite. However since the igniter FIG. 1, 15 is inert and significant amperage is required to ignite it, this should not be an issue. Unlike the current state of the art for small blasting, the current disclosure has no explosive or pyrotechnic material in the igniter, so it is not sensitive to pressure or heat as are explosive and pyrotechnic material igniters and thus is safer and much less likely to ignite accidentally. Due to the water resistant nature of the cartridge in this invention, water can be poured down the hole to submerge the cartridge(s) to increase containment and reduce noise.

If so desired the user can now put a rock, brick or other object FIG. 3, 29 on top of the blasting head FIG. 3, 26 with the preferred embodiment being to have a rubbery ring FIG. 6, 56 on top of it with a depression in the center so as to help hold a rock/other weight object to stay on top even if the drill hole is at a moderate angle. The user can at this point retrace his steps to a safe distance while reconnecting the blasting extension cord FIG. 4, 42 at both ends and to connect the blasting trigger FIG. 4, 40 to an electrical power source if it is not already connected. Then, the user makes sure it is safe to blast and pushes the trigger which sends electricity to the cartridge FIG. 5, 11 which ignites and then blasts what the user had targeted to blast such as the split boulder in FIG. 3, 31. This operation can be done with one blasting head or many at the same time as the electricity can be distributed to many heads easily with this invention. The current disclosure can be used without the trigger simply by plugging a cord in to a power source, but the preferred embodiment is to use the described safety apparatuses and methods. The preferred embodiment uses specialized electrical connectors so standard electrical plugs cannot be accidentally connected causing accidental ignition.

The setup time to do all the above operations except drilling is often less than three minutes. The time to drill a 10 mm hole, which is appropriate for a ⅜" cartridge and ⅜" blasting head rod, 10" deep can be as little as one minute in volcanic rocks, less than one minute in concrete and can be over four minutes in hard to drill rocks, such as chert. Currently a SDS rotary hammer drill to drill that fast can be bought for less than $100, so the equipment to drill the necessary holes for this invention is inexpensive and drilling times are quite acceptable While a number of exemplary aspects and embodiments have been discussed above, those of skill in the art will recognize certain modifications, permutations and additions and subcombinations thereof. It is therefore intended that the following appended claims and claims hereinafter introduced are interpreted to include all such modifications, permutations, additions and subcombinations that are within their true spirit and scope.

The invention claimed is:

1. A method of operating an apparatus that explodes, the method comprising:

directly igniting a propellant disposed inside a cartridge via an inert igniter/detonator not sensitive to shock and heat; and wherein:

the inert igniter/detonator generates sufficient melting and arcing to ignite the propellant;

neither pyrotechnic material nor explosives apart from the charge of propellant are required for ignition; and the igniter/detonator is ignitable by an AC or DC voltage that does not require high voltage.

2. The method of claim 1 further comprising:

sealing the propellant and the igniter/detonator inside the cartridge; and optionally submerging the apparatus in water.

3. The method of claim 1 further comprising:

electrically firing the inert igniter/detonator to heat/melt an electric bridge;

ionizing air around the electric bridge; and causing arcing across a gap in the electric bridge to ignite the propellant via heat.

4. An apparatus that explodes, comprising:

a cartridge;

a charge of propellant disposed inside the cartridge:

an inert igniter/detonator that is not sensitive to shock and heat, which is disposed directly in the propellant and wherein:

the inert igniter/detonator material has properties of melting and arcing that ignite the propellant;

neither pyrotechnic material nor explosives apart from the charge of propellant are required for ignition; and the igniter/detonator is ignitable by an AC or DC voltage that does not require high voltage.

5. The apparatus of claim 4 wherein:

the inert igniter/detonator is an electrical igniter/detonator.

6. The apparatus of claim 5 further comprising:

a blasting wire; and wherein:

the inert igniter/detonator includes an igniter bridge coupled to the blasting wire; and the igniter bridge comprises at least one of a bridge wire and a bridge ribbon.

7. The apparatus of claim 6 wherein:

the igniter bridge comprises a plurality of bridge wires or bridge ribbons.

8. The apparatus of claim 6 wherein:

the bridge wire or bridge ribbon is a stainless steel material that is inert up to a melting point of at least approximately 2,000 degrees F.

9. The apparatus of claim 4 wherein:

the cartridge having the inert igniter/detonator disposed therein can be detonated safely in a gloved hand without harm.

10. The apparatus of claim 4 wherein:

the cartridge having the inert igniter/detonator disposed therein is ignitable from a DC source having at least 3 volts.

11. The apparatus of claim 4 wherein:

the cartridge having the inert igniter/detonator disposed therein is ignitable from an AC power source.

12. The apparatus of claim 4 wherein:

the inert igniter/detonator does not require an electric match to detonate the propellant.

13. The method of claim 3 further comprising:

providing air in the cartridge that contains the inert igniter/detonator for an electrical arc in the ionized air.

14. The apparatus of claim 6 wherein:

the bridge wire of the inert igniter/detonator has a cross-section dimension between 0.001-0.003 inch.

15. The apparatus of claim 4 wherein:

the cartridge is sealed for water-resistance.

16. The apparatus of claim 4 wherein:

the inert igniter/detonator is disposed in a center location of the charge of propellant.

17. The method of claim 3 further comprising:

supplying a 110 volt alternating current (AC) to the inert igniter/detonator to create the melting and the arcing of the electric bridge.

18. The method of claim 3 further comprising:

increasing a length of the arcing or reducing a voltage required to create the arcing by ionizing air around the inert igniter/detonator from the melting of the electric bridge.

19. The method of claim 3 further comprising:

immunizing the apparatus from accidental ignition by at least one of static electricity and radio waves by requiring heating/melting of the electric bridge to ignite the charge of propellant.

20. The method of claim 1 further comprising:

igniting the igniter/detonator located in a center of the charge of propellant.

21. An explosive system comprising:

an explosive cartridge comprising:

a cartridge;

a charge of propellant disposed inside the cartridge:

an inert igniter/detonator that is not sensitive to shock and heat, which is disposed in the propellant and wherein:

the inert igniter/detonator generates sufficient melting and arcing to ignite the propellant; and neither pyrotechnic material nor explosives apart from the charge of propellant are required for ignition; and one or more booster cartridges disposed in a same bore hole with the explosive cartridge having the inert igniter/detonator disposed therein; and wherein:

the booster cartridges do not require an igniter or a blasting wire to be ignited by the explosive cartridge having the inert igniter/detonator disposed therein; and the igniter/detonator is ignitable by an AC or DC voltage that does not require high voltage.

22. The method of claim 1 wherein:

the inert igniter/detonator is ignitable by a DC voltage that is at least one of a low voltage or an extra-low voltage.

23. The apparatus of claim 6 wherein:

the igniter bridge construction melts at a DC voltage between 3 volts and 110 volts.

* * * * *